US012320069B2

(12) United States Patent
Yu et al.

(10) Patent No.: US 12,320,069 B2
(45) Date of Patent: Jun. 3, 2025

(54) CARBOXYLATED CELLULOSE NANOFIBER AND PREPARATION METHOD THEREOF

(71) Applicant: Northeast Forestry University, Harbin (CN)

(72) Inventors: Haipeng Yu, Harbin (CN); Xiaochao Shi, Harbin (CN); Qinqin Xia, Harbin (CN)

(73) Assignee: Northeast Forestry University, Harbin (CN)

( * ) Notice: Subject to any disclaimer, the term of this patent is extended or adjusted under 35 U.S.C. 154(b) by 202 days.

(21) Appl. No.: 18/068,847

(22) Filed: Dec. 20, 2022

(65) Prior Publication Data

US 2023/0160146 A1 May 25, 2023

(30) Foreign Application Priority Data

Dec. 24, 2021 (CN) ..... CN202111600313.7

(51) Int. Cl.
*D21H 11/20* (2006.01)
*D21C 9/00* (2006.01)
*D21H 11/18* (2006.01)

(52) U.S. Cl.
CPC ..... *D21H 11/20* (2013.01); *D21C 9/005* (2013.01); *D21H 11/18* (2013.01)

(58) Field of Classification Search
CPC ..... D21H 11/20; D21H 11/18; D21C 9/005; D21C 9/001; D21C 9/002
See application file for complete search history.

(56) References Cited

FOREIGN PATENT DOCUMENTS

| | | | | | |
|---|---|---|---|---|---|
| CN | 105713100 | A | * | 6/2016 | ..... C08B 15/02 |
| CN | 109705226 | A | | 5/2019 | |
| CN | 110130136 | A | | 8/2019 | |
| CN | 110804893 | A | | 2/2020 | |
| CN | 111228213 | A | * | 6/2020 | ..... A61K 31/405 |
| CN | 111979280 | A | | 11/2020 | |
| CN | 112709090 | A | | 4/2021 | |
| CN | 113461975 | A | | 10/2021 | |
| WO | WO-2022036010 | A1 | * | 2/2022 | ..... A01N 25/10 |

OTHER PUBLICATIONS

English Machine translation CN111228213A1, Jun. 2020. (Year: 2020).*
English Machine translation of CN105713100A, 2016. (Year: 2016).*
Yue Ma et al., "Production of Nanocellulose Using Hydrated Deep Eutectic Solvent Combined with Ultrasonic Treatment", ACS Omega, pp. 8539-8547.

* cited by examiner

*Primary Examiner* — Anthony Calandra

(57) ABSTRACT

Disclosed herein is a carboxylated cellulose nanofiber and a preparation method thereof. The method includes: mixing choline chloride, citric acid and water at 60-100° C. for 15-60 min to obtain a hydrated multi-carboxylic acid deep eutectic solvent (H-DES); mixing the H-DES and cellulose for hydrolysis-esterification reaction at 120-130° C. for 2-3 h to obtain a carboxylated cellulose; and mixing the carboxylated cellulose and water for nano-fibrillation to obtain the carboxylated cellulose nanofiber.

3 Claims, 16 Drawing Sheets

CARBOXYLATED CELLULOSE NANOFIBER AND PREPARATION METHOD THEREOF

CROSS-REFERENCE TO RELATED APPLICATIONS

This application claims the benefit of priority from Chinese Patent Application No. 202111600313.7, filed on Dec. 24, 2021. The content of the aforementioned application, including any intervening amendments thereto, is incorporated herein by reference in its entirety.

TECHNICAL FIELD

This application relates to functional materials, and more particularly to a carboxylated cellulose nanofiber and a preparation method thereof.

BACKGROUND

Cellulose nanofibers (CNFs) exhibit great potential for the development of sustainable multi-functional biocomposites due to their inherent nanostructures, and are considered as a promising alternative to petroleum-based raw materials. However, the presence of the strong hydrogen-bonding network makes the aqueous suspension of CNF less stable and prone to aggregation and precipitation, resulting in poor dispersion and limiting the functional application.

In order to enhance the dispersion and stability of the CNFs, chemical modifications are generally made under the action of 2,2,6,6-tetramethyl-1-piperidinyloxy (TEMPO), periodic acid, organic acid or acid anhydride to render the CNFs enriched in negatively-charged carboxylic groups, so as to obtain carboxylated cellulose nanofibers (C-CNFs). Nevertheless, the C-CNFs prepared in the presence of organic acid or acid anhydride generally have low aspect ratio and poor yield. The C-CNFs prepared in the presence of periodic acid further suffers from low carboxyl content. By comparison, the C-CNFs prepared in the presence of TEMPO have a relatively higher aspect ratio, but the TEMPO is expensive and highly toxic, and thus is not suitable for the industrial production.

SUMMARY

An objective of this application is to provide a carboxylated cellulose nanofiber and a preparation method thereof, where the method provided herein is low-cost and environmentally-friendly, and the carboxylated cellulose nanofiber prepared by the method has fine diameter, high aspect ratio, high carboxyl content and desirable yield.

Technical solutions of this application are described as follows.

In a first aspect, this application provides a method for preparing a carboxylated cellulose nanofiber, comprising:

mixing choline chloride, citric acid and water to obtain a hydrated multi-carboxylic acid deep eutectic solvent;

mixing the hydrated multi-carboxylic acid deep eutectic solvent with cellulose followed by hydrolysis-esterification reaction to obtain a carboxylated cellulose; and mixing the carboxylated cellulose and water followed by nano-fibrillation to obtain the carboxylated cellulose nanofiber.

In an embodiment, a molar ratio of the choline chloride to the citric acid is 1:(1-4).

In an embodiment, a ratio of a weight of the water to a total weight of the choline chloride and the citric acid is (0.25~4):1.

In an embodiment, the choline chloride, the citric acid and water are mixed at 60-100° C. for 15-60 min.

In an embodiment, the cellulose is selected from the group consisting of pulp fiber, microcrystalline cellulose, purified cellulose and pulp board.

In an embodiment, a weight ratio of the hydrated multi-carboxylic acid deep eutectic solvent to the cellulose is 100:(0.1~6).

In an embodiment, the hydrolysis-esterification reaction is performed at 100-150° C. for 1-5 h.

In an embodiment, the nano-fibrillation is performed under an ultrasonic power of 600-1000 W for 10-60 min.

In a second aspect, this application provides a carboxylated cellulose nanofiber, which is fabricated by the above method.

In an embodiment, the carboxylated cellulose nanofiber has a carboxyl content of 0.23~1.45 mmol/g, and an aspect ratio of 1000~4000.

In an embodiment, the carboxylated cellulose nanofiber has a yield of 77.02~93.26%, a polymerization degree of 450-730, and a zeta potential of −27.1~-43.7 mV.

Compared to the prior art, this application has the following beneficial effects.

The method provided herein adopts a green and low-cost hydrated multi-carboxylic acid deep eutectic solvent (H-DES) composed of choline chloride, citric acid and water, which allows a mild treatment condition for the cellulose. The H-DES is capable of breaking the hydrogen bonds of cellulose while maintaining the characteristics of the cellulose nanofibers, such as fine diameter and high aspect ratio.

Simultaneously, the H-DES is capable of chemically modifying the cellulose nanofibers to effectively expose more carboxyl sites, such that the carboxylated cellulose nanofibers have high carboxyl content and high yield. In addition, the method provided herein is simple in operation, which facilitates the large-scale production.

DETAILED DESCRIPTION OF EMBODIMENTS

Figure 1:
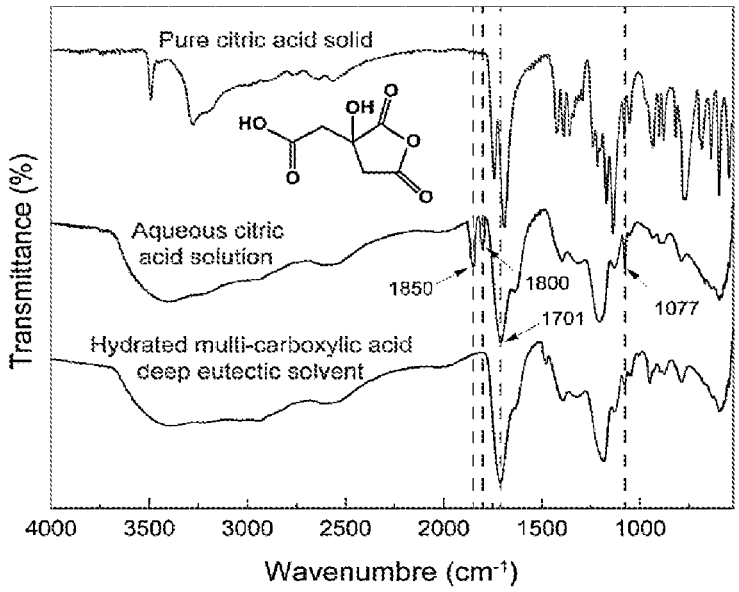
FIG. 1 schematically shows Fourier transform infrared (FTIR) spectra of pure citric acid solid, an aqueous citric acid solution and a hydrated multi-carboxylic acid deep eutectic solvent (H-DES) according to an embodiment of the disclosure.

Provided herein is a method for preparing a carboxylated cellulose nanofiber, including:

mixing choline chloride, citric acid and water to obtain a hydrated multi-carboxylic acid deep eutectic solvent;

mixing the hydrated multi-carboxylic acid deep eutectic solvent with cellulose followed by hydrolysis-esterification reaction to obtain a carboxylated cellulose; and mixing the carboxylated cellulose with water followed by nano-fibrillation to obtain the carboxylated cellulose nanofiber.

In this application, choline chloride, citric acid and water are mixed to obtain the hydrated multi-carboxylic acid deep eutectic solvent (H-DES), where water is preferably distilled water; a molar ratio of the choline chloride to the citric acid is 1:(1-4), e.g., 1:1, 1:2, 1:3 and 1:4; and a ratio of a weight of water to a total weight of the choline chloride and the citric acid is (0.25~4):1, e.g., 4:1, 1:1 and 1:4. The choline chloride and the citric acid are functional components, and water is employed as solvent. Functionally, water plays a role not only in adjusting the acidity of the H-DES to control the protonation, but also in forming hydrogen bonds with the hydroxyl groups on cellulose to avoid the over-hydrolysis of cellulose, promoting molecular delocalization and expanding the accessible surface area to promote the esterification reaction. Simultaneously, the water can make the cellulose more swellable to facilitate the subsequent ultrasonic treatment. Food additive citric acid is employed as a hydrogen bond donor. The citric acid is not only an environmentally-friendly organic acid, but also a tricarboxylic acid compound rich in carboxyl sites, such that it has more reaction sites with cellulose through different esterification routes, facilitating the grafting of more carboxylic groups. However, the citric acid is prone to dehydration to form a cyclic anhydride, which hinders the preservation of carboxyl sites and reduces the carboxyl content of C-CNF. Therefore, the choline chloride (ChCl) is selected as the hydrogen bond acceptor, in which the —OH and $Cl^-$ can compete with the carboxyl groups in the citric acid to form H-bonds, effectively inhibiting the formation of cyclic anhydride by self-dehydration and preserving more carboxylic groups. In addition, $Cl^-$ can also compete with the hydroxyl groups of cellulose and water molecules to form hydrated anionic hydrogen bonds, so as to adjust the properties of the solvent. In this application, the choline chloride, the citric acid and water are mixed at 60-100° C. for 15-60 min, preferably at 70~80° C. for 20-30 min. By means of the hydrogen bonding, the choline chloride, citric acid and water together form a uniform and transparent mixture, namely H-DES, whose melting point is lower than that of the constitutive components therein.

After that, the H-DES is mixed with the cellulose for hydrolysis-esterification reaction to obtain a carboxylated cellulose, where the cellulose is selected from the group consisting of pulp fiber, microcrystalline cellulose, purified cellulose and pulp board, preferably pulp fiber; a weight ratio of the H-DES to the cellulose is 100:(0.1~6), preferably 100:(1~4.5); the hydrolysis-esterification reaction is performed at 100~150° C. for 1~5 h, preferably at 120~130° C. for 2~3 h; and the hydrolysis-esterification reaction is preferably performed under reflux condensation. During the hydrolysis-esterification reaction, the H-DES is capable of breaking the hydrogen-bonding network of cellulose while simultaneously grafting carboxyl groups onto the cellulose through the esterification between the citric acid and the cellulose to prepare the carboxylated cellulose.

After the hydrolysis-esterification reaction, the resultant carboxylated cellulose and water are mixed, cooled and washed to neutrality to obtain a carboxylated cellulose-water mixture, where a weight ratio of the carboxylated cellulose to water is 1:(6-10), preferably 1:(8-8.5); the water is preferably distilled water; and the mixture is preferably cooled to room temperature. In an embodiment of this application, the room temperature is 25° C. In this application, the washing is preferably performed by vacuum filtration. In an embodiment of this application, the vacuum filtration is performed via a sand core funnel. In this application, a concentration of carboxylated cellulose in the carboxylated cellulose-water mixture is controlled at 6-10 wt %. In this application, the mixture is washed to neutrality to remove the excess H-DES in the hydrolysis-esterification reaction system, so as to obtain the carboxylated cellulose-water mixture.

The carboxylated cellulose and water are mixed and subjected to nano-fibrillation to obtain the carboxylated cellulose nanofibers. In this application, the carboxylated cellulose and water are mixed to obtain an aqueous carboxylated cellulose dispersion with a concentration of 0.1~10 wt %, preferably 0.5~1 wt %. Within the above-mentioned range, the carboxylated cellulose-water mixture may be directly subjected to the nano-fibrillation, or first mixed with water and then subjected to nano-fibrillation, which is not particularly limited herein. In this application, the nano-fibrillation is performed under an ultrasonic power of 600-1000 W for 10-60 min, preferably 700-800 W for 20-30 min.

The H-DES composed of choline chloride, citric acid and water is green and low-cost, and can break the hydrogen bonds of the cellulose under a mild condition while grafting multiple carboxyl groups onto cellulose through esterification, without breaking the glycosidic linkage and amorphous regions of the cellulose, and reducing the aspect ratio. Simultaneously, the choline chloride and the citric acid are capable of chemically modifying the cellulose nanofibers. The steric hindrance in the H-DES effectively prevents the formation of the cyclic anhydrides, thereby preserving more carboxyl sites and increasing the carboxyl content. In addition, due to the high carboxyl content, the generated strong electrostatic repulsion enables the C-CNFs to be uniformly dispersed in water, effectively improving the stability of the aqueous C-CNF suspension. Therefore, the C-CNFs fabricated herein exhibit brilliant commercial application prospects.

The carboxylated cellulose nanofiber prepared by the method mentioned above has a carboxyl content of 0.23~1.45 mmol/g, and an aspect ratio of 1000~4000. In this application, the carboxylated cellulose nanofiber has a yield of 77.02~93.26%, a polymerization degree of 450-730, and a zeta potential of −27.1~-43.7 mV.

The disclosure will be described in detail below with reference to the accompanying drawings and embodiments to make the technical solutions clear and complete. Obviously, described below are merely some embodiments of the disclosure, and are not intended to limit the disclosure. Based on the embodiments provided herein, other embodiments obtained by those of ordinary skill in the art without paying creative effort shall fall within the scope of this disclosure defined by the appended claims.

Example 1

33.67 g of choline chloride (ChCl), 46.33 g of citric acid (a molar ratio of ChCl to citric acid was 1:1) and 20 g of distilled water were mixed at 80° C. for 30 min to obtain a hydrated multi-carboxylic acid deep eutectic solvent (H-DES). 100 g of the H-DES was added with 4.5 g of pulp fiber and reacted at 130° C. under reflux condensation and stirring for 3 h. The reaction mixture was mixed with 800 mL of distilled water, cooled to room temperature (25° C.), and subjected to vacuum filtration and washing in a sand core funnel to reach pH 7 to obtain a carboxylated cellulose-water mixture, where a concentration of carboxylated cellulose in the carboxylated cellulose-water mixture was controlled at 6-10 wt %. The carboxylated cellulose-water mixture was mixed with water to obtain an aqueous carboxylated cellulose dispersion with a concentration of 0.5 wt %. Then, the aqueous carboxylated cellulose dispersion was subjected to ultrasonic treatment at a power of 800 W for 30 min to obtain an aqueous carboxylated cellulose nanofiber suspension (aqueous C-CNF suspension) with a C-CNF concentration of 0.5 wt %, which was stored in the refrigerator for use.

Example 2

Example 2 was basically the same as Example 1, except that the H-DES in this example was prepared from 21.32 g of choline chloride (ChCl), 58.68 g of citric acid (a molar ratio of ChCl to citric acid was 1:2) and 20 g of distilled water.

Example 3

Example 3 was basically the same as Example 1, except that the hydrated multi-carboxylic acid deep eutectic solvent was prepared from 15.6 g of choline chloride (ChCl), 64.4 g of citric acid (a molar ratio of ChCl to citric acid was 1:3) and 20 g of distilled water (a ratio of a weight of distilled water to a total weight of ChCl and citric acid was 1:4).

Example 4

Example 4 was basically the same as Example 1, except that the hydrated multi-carboxylic acid deep eutectic solvent was prepared from 12.3 g of choline chloride (ChCl), 67.7 g of citric acid (a molar ratio of ChCl to citric acid was 1:4) and 20 g of distilled water.

Example 5

Example 5 was basically the same as Example 1, except that the hydrated multi-carboxylic acid deep eutectic solvent was prepared from 3.9 g of choline chloride (ChCl), 16.1 g of citric acid (a molar ratio of ChCl to citric acid was 1:3) and 80 g of distilled water (a ratio of a weight of distilled water to a total weight of ChCl and citric acid was 4:1).

Example 6

Example 6 was basically the same as Example 1, except that the hydrated multi-carboxylic acid deep eutectic solvent was prepared from 9.75 g of choline chloride (ChCl), 40.25 g of citric acid (a molar ratio of ChCl to citric acid was 1:3) and 50 g of distilled water (a ratio of a weight of distilled water to a total weight of ChCl and citric acid was 1:1).

Comparative Example 1

100 g of distilled water was added with 0.5 g of pulp fiber, and subjected to ultrasonic treatment at a power of 800 W to obtain an aqueous cellulose nanofiber suspension (aqueous CNF suspension) with a CNF concentration of 0.5 wt %.

Characterization and Performance Test

1. The H-DES was characterized and compared with the citric acid solid and the aqueous citric acid solution through the following steps.

7 g of citric acid solid was weighed and labeled as Sample 1.

33.67 g of ChCl and 46.33 g of citric acid (a molar ratio of ChCl to citric acid was 1:3) were added to 20 g of distilled water (a ratio of the weight of distilled water to a total weight of ChCl and citric acid was 1:4), reacted under stirring and reflux condensation in an oil bath at 80° C. for 30 min, and cooled until the mixture became clarified, so as to obtain the hydrated multi-carboxylic acid deep eutectic solvent, which was labeled as sample 2.

20 g of distilled water was added with 33.67 g of citric acid, reacted under stirring and reflux condensation in an oil bath at 80° C. for 30 min, and cooled until the mixture became clarified, so as to obtain an aqueous citric acid solution, which was labeled as sample 3.

Figure 2:
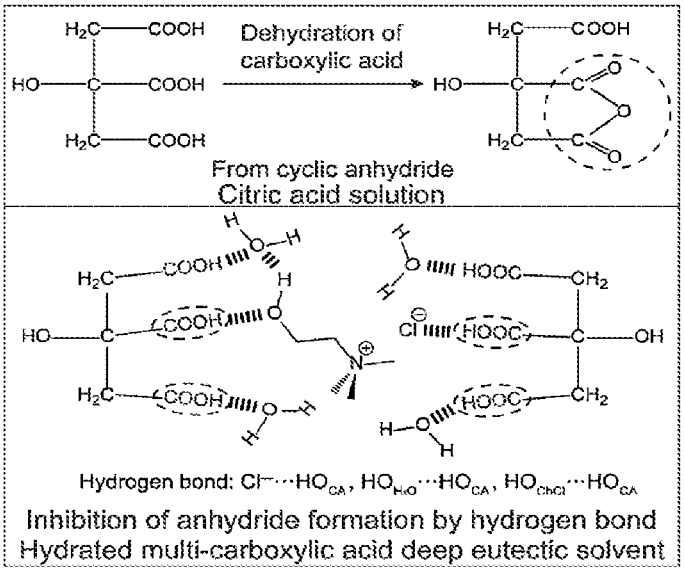
FIG. 2 schematically illustrates the formation of cyclic anhydride through self-dehydration of citric acid, inhibition of anhydride formation by choline chloride (ChCl) and $H_2O$ and retention of carboxyl sites.

The sample 1, sample 2 and sample 3 were analyzed by Fourier transform infrared (FTIR) spectroscopy, and the results were shown in FIG. 1. FIG. 1 schematically shows Fourier transform infrared (FTIR) spectra of pure citric acid solid, an aqueous citric acid solution and a hydrated multi-carboxylic acid deep eutectic solvent (H-DES). FIG. 2 schematically illustrates the formation of cyclic anhydride through self-dehydration of citric acid, inhibition of anhydride formation by choline chloride (ChCl) and $H_2O$ and retention of carboxyl sites. Referring to FIG. 1, each of samples 1-3 had a strong signal peak at 1701 $cm^{-1}$, which was assigned to the stretching vibration of the carbonyl group in the citric acid carboxyl group. However, the aqueous citric acid solution had three new strong-band signal peaks respectively at 1850 $cm^{-1}$, 1800 $cm^{-1}$ and 1077 cm-1. The peak at 1850 $cm^{-1}$ corresponds to a symmetric C═O stretching (non-coplanar) signal of a five-membered cyclic anhydride. The signal peak at 1800 $cm^{-1}$ corresponds to a symmetric C═O stretching (coplanar) signal peak of the five-membered cyclic anhydride. The peak at 1077 $cm^{-1}$ corresponds to the stretching vibration of C—O—C of the five-membered cyclic anhydride. The results indicated that the carboxylic acid groups of citric acid are prone to dehydration to form cyclic anhydrides. The formation of a cyclic anhydride will hinder the release of carboxyl sites, thereby lowering the carboxyl content. It was worth noting that the above-mentioned signal peaks were not detected in the hydrated multi-carboxylic acid deep eutectic solvent, indicating that the addition of ChCl effectively inhibited the formation of cyclic anhydride and played a role in steric hindrance. ChCl and water were added, such that three hydrogen bonds consisting of Cl-ChCl . . . $HO_{citric\ acid}$, $HO_{ChCl}$ . . . $HO_{citric\ acid}$ and $HO_{water}$ . . . $HO_{citric\ acid}$ are formed among ChCl, water and citric acid, which inhibits the dehydration of carboxylic acid groups on the citric acid, and retains more carboxyl sites (demonstrated in FIG. 2).

2. C-CNF prepared by each of the Examples 1-6 and CNF prepared by Comparative Example 1 were tested through the following steps.

The aspect ratio of each of C-CNF and CNF was determined by transmission electron microscopy (TEM). The carboxyl content of each of C-CNF and CNF was determined by conductance titration, and the performances of C-CNF and CNF were characterized by parameters such as yield, zeta potential and polymerization degree. The results were shown in Table 1.

TABLE 1

Performance parameters of C-CNFs prepared by Examples 1-6 and CNF prepared by Comparative Example 1

| Parameter | Examples 1 | 2 | 3 | 4 | 5 | 6 | Comparative Example 1 |
|---|---|---|---|---|---|---|---|
| Carboxyl content(mmol/g) | 0.60 | 1.12 | 1.34 | 1.45 | 0.23 | 0.79 | 0.02 |
| Aspect ratio | ~1000 | ~3000 | ~4000 | ~2500 | ~1500 | ~2300 | ~260 |
| Yield (%) | 90.96 | 90.25 | 89.50 | 77.02 | 93.26 | 91.06 | \ |
| Zeta potential (mV) | −34.8 | −40.5 | −43.1 | −43.7 | −27.1 | −36.1 | \ |
| polymerization degree | 680 | 600 | 530 | 450 | 730 | 630 | 1012 |

Figure 3:
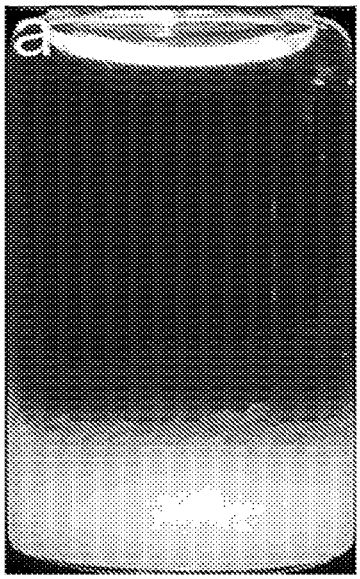
FIG. 3 is a photograph of an aqueous cellulose nanofiber (CNF) suspension prepared in Comparative Example 1.
Figure 4:
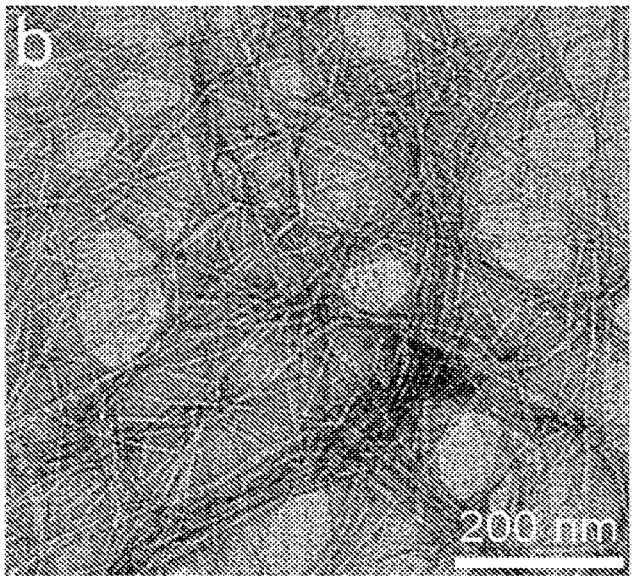
FIG. 4 is a transmission electron microscope (TEM) image of the aqueous CNF suspension prepared in Comparative Example 1.
Figure 5:
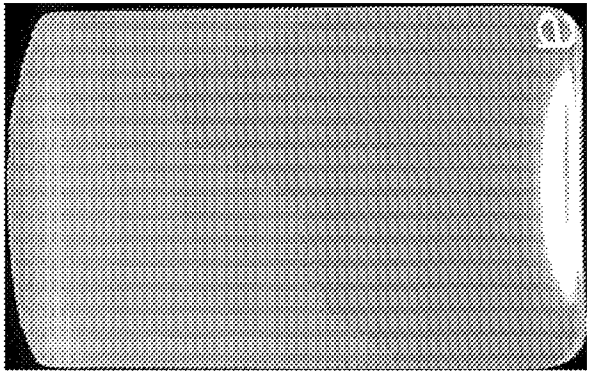
FIG. 5 is a photograph of an aqueous carboxylated cellulose nanofiber (C-CNF) suspension prepared in Example 1.
Figure 6:
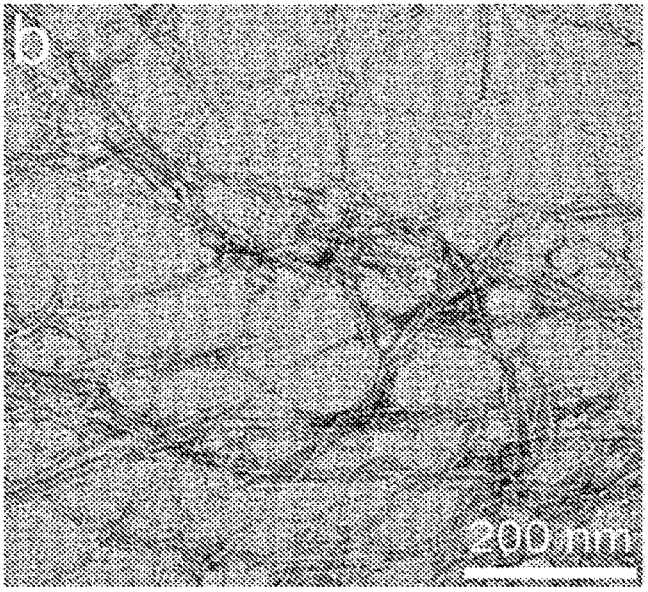
FIG. 6 is a TEM image of the aqueous C-CNF suspension prepared in Example 1.
Figure 7:
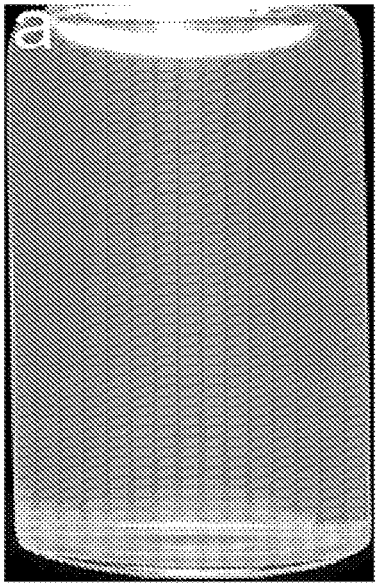
FIG. 7 is a photograph of an aqueous C-CNF suspension prepared in Example 2.
Figure 8:
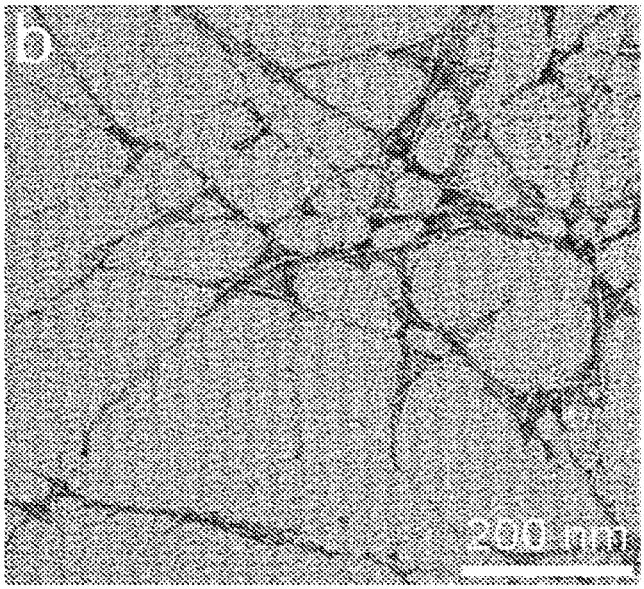
FIG. 8 is a TEM image of the aqueous C-CNF suspension prepared in Example 2.
Figure 9:
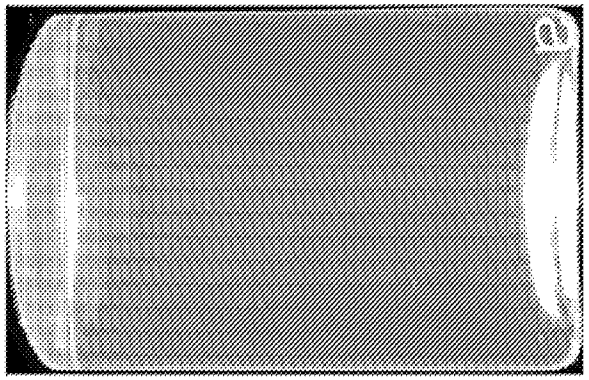
FIG. 9 is a photograph of an aqueous C-CNF suspension prepared in Example 3.
Figure 10:
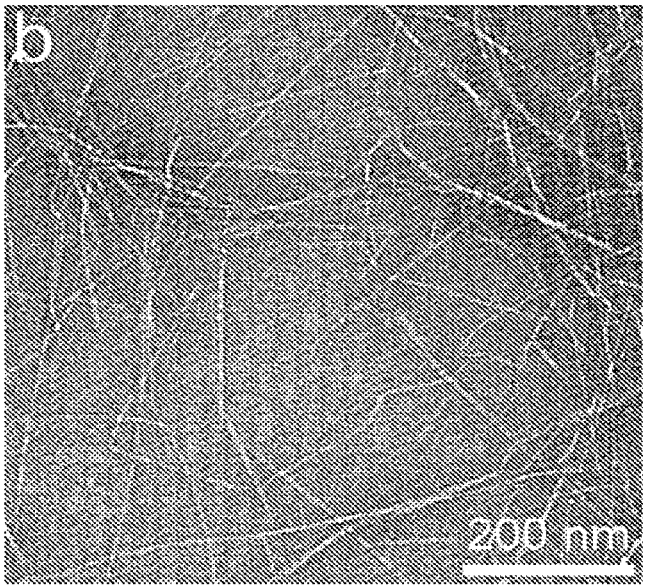
FIG. 10 is a TEM image of the aqueous C-CNF suspension prepared in Example 3.
Figure 11:
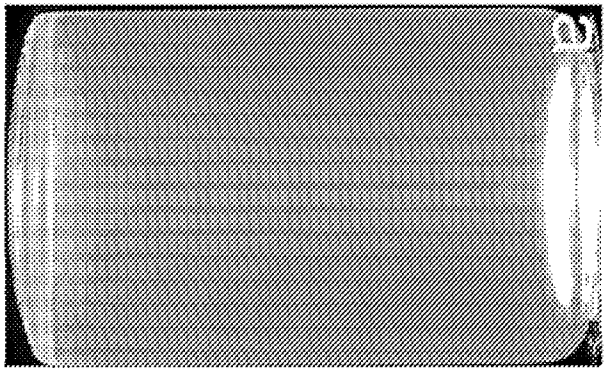
FIG. 11 is a photograph of an aqueous C-CNF suspension prepared in Example 4.
Figure 12:
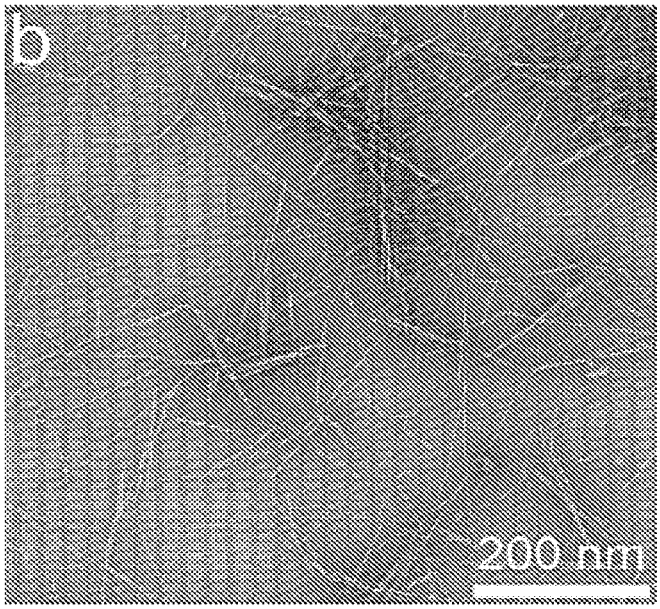
FIG. 12 is a TEM image of the aqueous C-CNF suspension prepared in Example 4.
Figure 13:
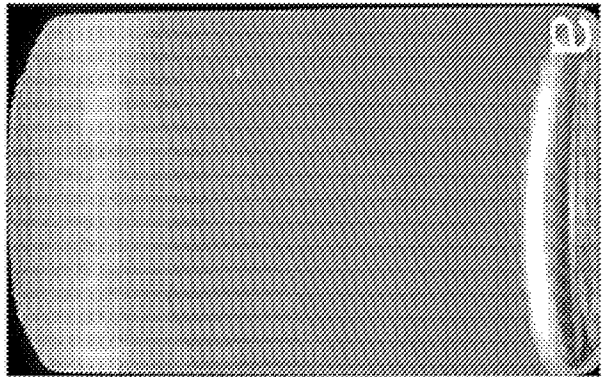
FIG. 13 is a photograph of an aqueous C-CNF suspension prepared in Example 5.
Figure 14:
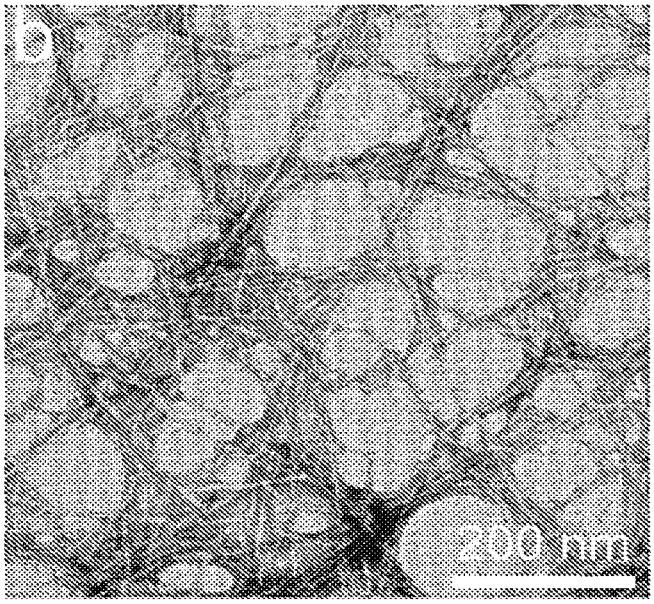
FIG. 14 is a TEM image of the aqueous C-CNF suspension prepared in Example 5.
Figure 15:
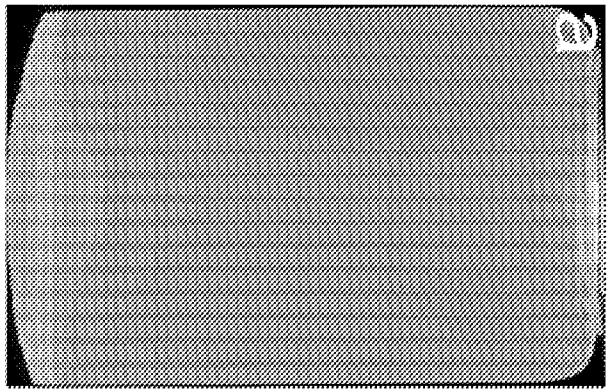
FIG. 15 is a photograph of an aqueous C-CNF suspension prepared in Example 6.
Figure 16:
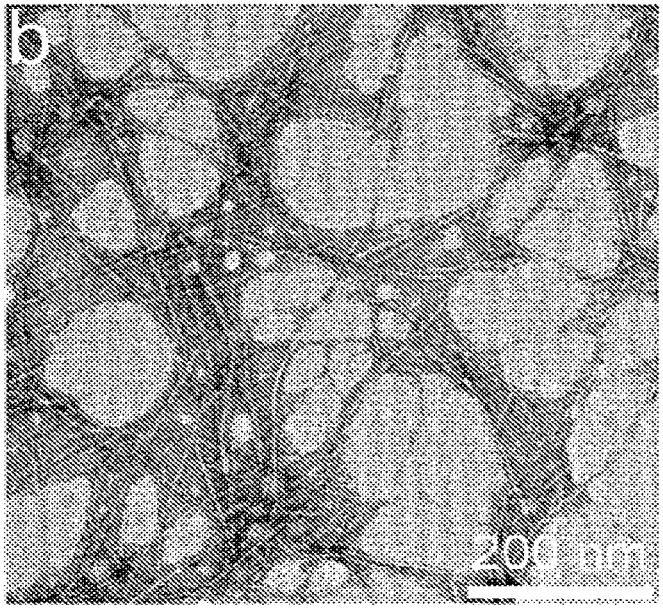
FIG. 16 is a TEM image of the aqueous C-CNF suspension prepared in Example 6.

It can be demonstrated from Table 1 that when the hydrated multi-carboxylic acid deep eutectic solvent was employed to process the cellulose, C-CNFs with different functional properties can be obtained due to carboxylation. Specifically, with the increase of the citric acid content (decrease of the water content), the carboxyl content and zeta potential increased; the aspect ratio first increased and then decreased; and the yield and the polymerization degree tended to decrease. The results indicated that the hydrated multi-carboxylic acid deep eutectic solvent can effectively modify CNF, such that the CNF was enriched with the carboxylic groups (0.23~1.45 mmol/g), and had high aspect ratio (1000~4000), high yield (77.02~93.26%), high potential value (−27.1~-43.7 mV) and higher polymerization degree (450~730). 3. The aqueous C-CNF suspension prepared in each of Examples 1-6 was characterized, and compared with the aqueous C-CNF suspension prepared in Comparative Example 1. The results were shown in FIGS. 3-16. FIGS. 3 and 4 correspond to the CNF prepared in Comparative Example 1. FIGS. 5 and 6 correspond to the C-CNF prepared in Example 1. FIGS. 7 and 8 correspond to the C-CNF prepared in Example 2. FIGS. 9 and 10 correspond to the C-CNF prepared in Example 3. FIGS. 11 and 12 correspond to the C-CNF prepared in Example 4. FIGS. 13 and 14 correspond to the C-CNF prepared in Example 5. FIGS. 15 and 16 correspond to the C-CNF prepared in Example 6. The conclusions drawn from FIGS. 3-16 were illustrated as follows.

The aqueous CNF suspension prepared in Comparative Example 1 exhibited obvious precipitation (see FIG. 3). However, the aqueous C-CNF suspension prepared by using the hydrated multi-carboxylic acid deep eutectic solvent provided herein had good stability, and still maintained in a uniformly-dispersed state even after 6 months.

With the increase of citric acid content, the transparency effect of aqueous C-CNF suspension was improved (see FIGS. 5-12). When the molar ratio of ChCl to citric acid exceeded 1:2, an almost transparent dispersion could be obtained, and the aqueous C-CNF suspension exhibited a light blue color (see FIGS. 7-12).

As shown in a TEM image in FIG. 4, it shows that the CNF prepared in Comparative Example 1 agglomerated. However, the C-CNF prepared by using the hydrated multi-carboxylic acid deep eutectic solvent provided herein did not agglomerate, and was mainly composed of a single elementary fibril.

Most of the C-CNFs prepared in Example 1 were composed of elementary fibrils with a diameter below 10 nm. However, under the action of hydrogen bonds, the C-CNFs prepared in Example 1 entangled with each other to form a network structure (see FIG. 6). In Example 2, with the increase of citric acid content, the strong hydrogen bonding between the molecular chains of cellulose was effectively destroyed.

Consequently, the C-CNF prepared in Example 2 had a diameter below 5 nm, a length ranging from 13 to 15 m (see FIG. 8), and a morphological feature of typical CNF. The C-CNF prepared in Example 3 had a narrower diameter (3 nm), and a length, which was not shortened significantly (12-14 μm) (FIG. 10). Compared with the C-CNF prepared in Example 2, the C-CNF prepared in Example 3 had a longer length and greater dispersion performance. If the content of citric acid continues to increase, the length of the C-CNF obtained in Example 4 was obviously shortened, which was intermediate between the length of cellulose nanofiber and the length of cellulose noncrystalline (see FIG. 12). The results indicated that reaction system in Example 4 was excessively strong, resulting in partial hydrolysis of the C-CNF, such that the length of C-CNF was shortened.

Referring to FIGS. 13-16, with the decrease of water content, C-CNF changed from aggregates of elementary fibrils to uniformly-dispersed single elementary fibril. When the water content decreased from 80% to 50%, for the C-CNF, the length decreased slightly (~15 μm), but the diameter became thinner and the aspect ratio is higher (see FIGS. 15 and 16). It indicated that excess water can form hydrated hydrogen bonds with cellulose, so as to wrap the cellulose surface, which not only prevents the over hydrolysis of cellulose, but also inhibits the chemical modification to the cellulose, which was caused by the hydrated multi-carboxylic acid deep eutectic solvent. Therefore, appropriate amount of water could create a milder chemical modification environment.

Moreover, from the statistics of the aspect ratio of C-CNF prepared by each of Examples 1-6, it was found that with the increase of citric acid content and the decrease of water content, the aspect ratio first increased and then decreased (see Table 1). The C-CNF prepared in Example 3 had the highest aspect ratio of 4000. If the citric acid content was too low, it is not enough for the hydrated multi-carboxylic acid deep eutectic solvent to destroy the strong hydrogen-bonding network among cellulose. Moreover, the C-CNF existed in a form of elementary fibril aggregate, resulting in a decrease of aspect ratio. If the citric acid content is too high, the cellulose is partially degraded after being treated with a hydrated multi-carboxylic acid deep eutectic solvent, resulting in a decrease of the aspect ratio. Consequently, in the pretreatment stage of cellulose, the addition of water can effectively reduce the acidity of the hydrated multi-carboxylic acid deep eutectic solvent, thereby weakening the interaction among the cellulose, and preventing the over hydrolysis of cellulose while effectively destroying the hydrogen bonds of the cellulose, which was caused by the hydrated multi-carboxylic acid deep eutectic solvent. In this way, the cellulose was effectively modified by choline chloride and citric acid.

From the results of the above-mentioned examples, the hydrated multi-carboxylic acid deep eutectic solvent used herein can effectively prepare the C-CNF with high carboxyl content and high aspect ratio, inhibit the formation of cyclic anhydrides from polycarboxylic acids, and solve the problem of aggregation and precipitation of CNF.

Described above are merely preferred embodiments of the disclosure, which are not intended to limit the scope of the application. It should be noted that any improvements, changes, and modifications made by those skilled in the art without departing from the spirit of the application shall fall within the scope of the present application defined by the appended claims.

What is claimed is:

1. A method for preparing a carboxylated cellulose nanofiber, comprising:

(1) mixing choline chloride, citric acid and water at 60-100° C. for 15-60 minutes to obtain a hydrated multi-carboxylic acid deep eutectic solvent;

(2) mixing the hydrated multi-carboxylic acid deep eutectic solvent with cellulose followed by hydrolysis-esterification reaction at 120-130° C. for 2-3 hours to obtain a carboxylated cellulose; and (3) mixing the carboxylated cellulose and water followed by nano-fibrillation to obtain the carboxylated cellulose nanofiber;

wherein in step (1), a ratio of a weight of the water to a total weight of the choline chloride and the citric acid is (0.25~4):1; and a molar ratio of the choline chloride to the citric acid is 1:(1~4);

the carboxylated cellulose nanofiber has a carboxyl content of 0.23~1.45 mmol/g, and an aspect ratio of 1000~4000; and the nano-fibrillation is performed under an ultrasonic power of 600-1000 Watts for minutes min.

2. The method of claim 1, wherein the cellulose is selected from the group consisting of pulp fiber, purified cellulose and pulp board.

3. The method of claim 1, wherein a weight ratio of the hydrated multi-carboxylic acid deep eutectic solvent to the cellulose is 100:(0.1~6).

* * * * *